US012590466B2

(12) United States Patent
Fowler

(10) Patent No.: US 12,590,466 B2
(45) Date of Patent: Mar. 31, 2026

(54) POOL FILTER PROTECTION DEVICE

(71) Applicant: Greg Fowler, Victorville, CA (US)

(72) Inventor: Greg Fowler, Victorville, CA (US)

( * ) Notice: Subject to any disclaimer, the term of this patent is extended or adjusted under 35 U.S.C. 154(b) by 412 days.

(21) Appl. No.: 18/386,425

(22) Filed: Nov. 2, 2023

(65) Prior Publication Data

US 2025/0146313 A1 May 8, 2025

(51) Int. Cl.
*E04H 4/12* (2006.01)

(52) U.S. Cl.
CPC ..... *E04H 4/1218* (2013.01)

(58) Field of Classification Search
CPC ..... E04H 4/1218
USPC ..... 210/541, 167.12, 167.13, 167.14
See application file for complete search history.

(56) References Cited

U.S. PATENT DOCUMENTS

| | | | | |
|---|---|---|---|---|
| 4,811,767 | A | 3/1989 | Kessler | |
| 5,685,977 | A | 11/1997 | Golston | |
| D393,307 | S | 4/1998 | Golston | |
| 6,123,187 | A * | 9/2000 | Bartels | F17C 13/001 206/459.1 |
| 6,508,282 | B2 | 1/2003 | Garofalo | |
| 7,117,908 | B1 * | 10/2006 | Coron | F17C 3/00 150/154 |
| 7,316,435 | B2 * | 1/2008 | Leighton | A45C 11/00 D23/206 |
| 7,753,589 | B2 | 7/2010 | Palt | |
| D711,501 | S | 8/2014 | Somers | |
| 10,619,796 | B1 * | 4/2020 | Wood | F17C 13/084 |
| 2013/0133796 | A1 | 5/2013 | Williams | |
| 2013/0272856 | A1 | 10/2013 | Stockly, Jr. | |

FOREIGN PATENT DOCUMENTS

| | | |
|---|---|---|
| CA | 2867606 | 4/2015 |

* cited by examiner

*Primary Examiner* — Fred Prince

(57) ABSTRACT

A pool filter protection device includes a hood that is shaped to define a dome which can be placed over a housing for a pool filter. The hood has a hole extending through the hood to accommodate a pressure gauge on the housing. The hood is comprised of an opaque material to protect the housing from ultraviolet light thereby inhibiting the housing from being degraded by sunlight. The hood is comprised of a fluid impermeable material to inhibit fibers from the housing from irritating skin of a user when the user is servicing the pool filter. A cover is removably attachable to the hood has the cover is aligned with the hole and the cover is comprised of a mesh material to facilitate the pressure gauge to be visible to the user through the cover.

7 Claims, 9 Drawing Sheets

POOL FILTER PROTECTION DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to pool filter devices and more particularly pertains to a new pool filter device for protecting a pool filter housing from ultraviolet radiation. The device includes a hood that is positionable over the pool filter housing and which is comprised of an opaque material to protect the pool filter housing from ultraviolet light. The hood has a hole to accommodate a pressure gauge when the hood is positioned over the pool filter housing and the device includes a cover, comprised of a mesh material, that is attachable to the hood and which covers the pressure gauge to facilitate the pressure gauge to be visible through the mesh material of the cover.

(2) Description of Related Art Including Information Disclosed Under 37 CFR 1.97 and 1.98

The prior art relates to pool filter devices including a variety of cylindrical pool filter cover devices that is each positionable around a pool filter and which is each comprised of an opaque material to protect the pool filter from ultraviolet light and a pair of dome shaped pool filter cover devices that each has a hole for accommodating a pressure gauge on a pool filter housing. In no instance does the prior art disclose a dome shaped hood that is positionable over a pool filter housing which has a hole to accommodate a pressure gauge and a magnet for magnetically engaging the pool filter housing for retaining the hood on the pool filter housing.

(h) BRIEF SUMMARY OF THE INVENTION

An embodiment of the disclosure meets the needs presented above by generally comprising a hood that is shaped to define a dome which can be placed over a housing for a pool filter. The hood has a hole extending through the hood to accommodate a pressure gauge on the housing. The hood is comprised of an opaque material to protect the housing from ultraviolet light thereby inhibiting the housing from being degraded by sunlight. The hood is comprised of a fluid impermeable material to inhibit fibers from the housing from irritating skin of a user when the user is servicing the pool filter. A cover is removably attachable to the hood has the cover is aligned with the hole and the cover is comprised of a mesh material to facilitate the pressure gauge to be visible to the user through the cover.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
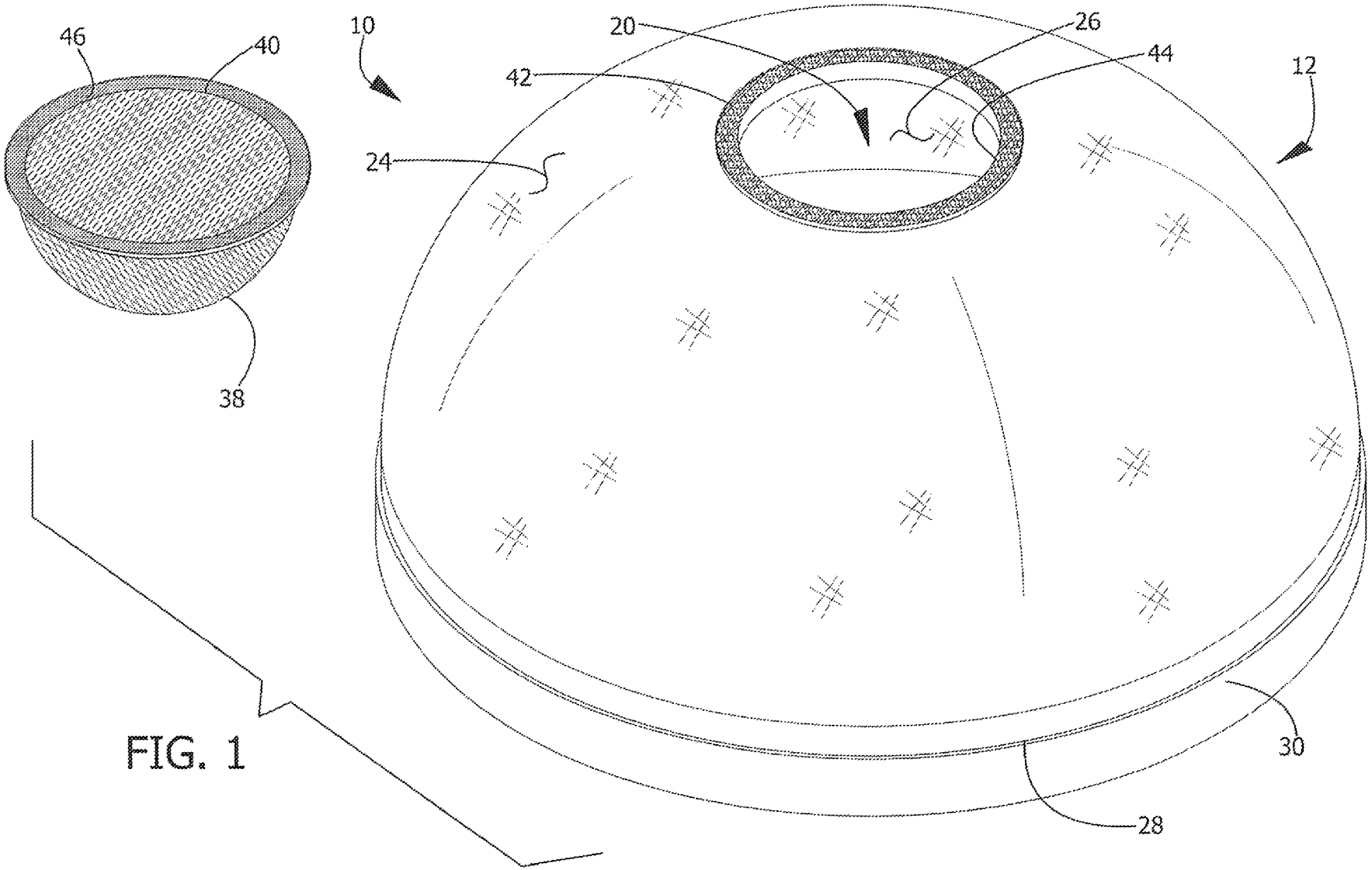
FIG. 1 is a perspective view of a pool filter protection device according to an embodiment of the disclosure.
Figure 2:
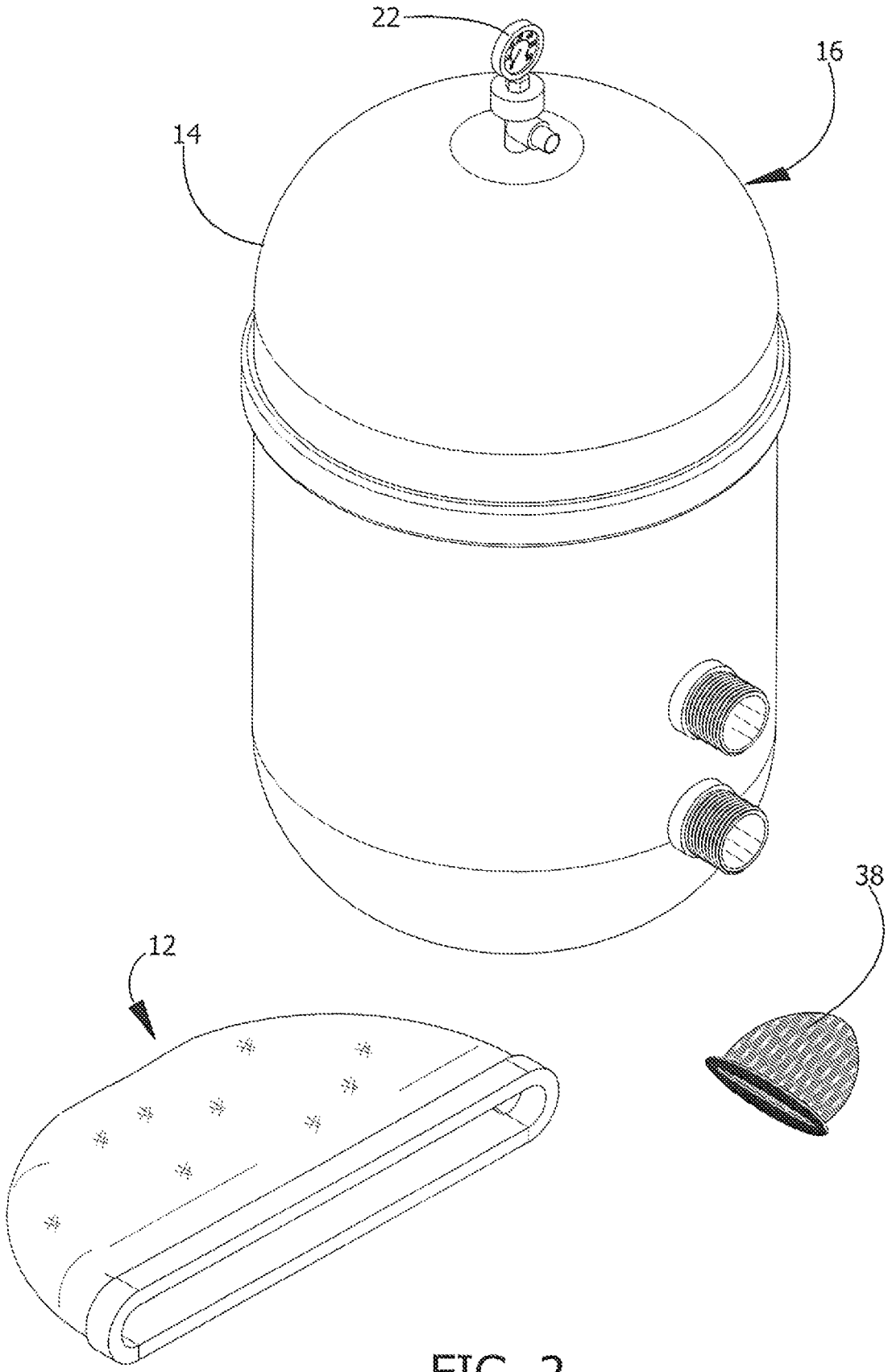
FIG. 2 is a perspective view of an embodiment of the disclosure which shows a pool filter housing.
Figure 3:
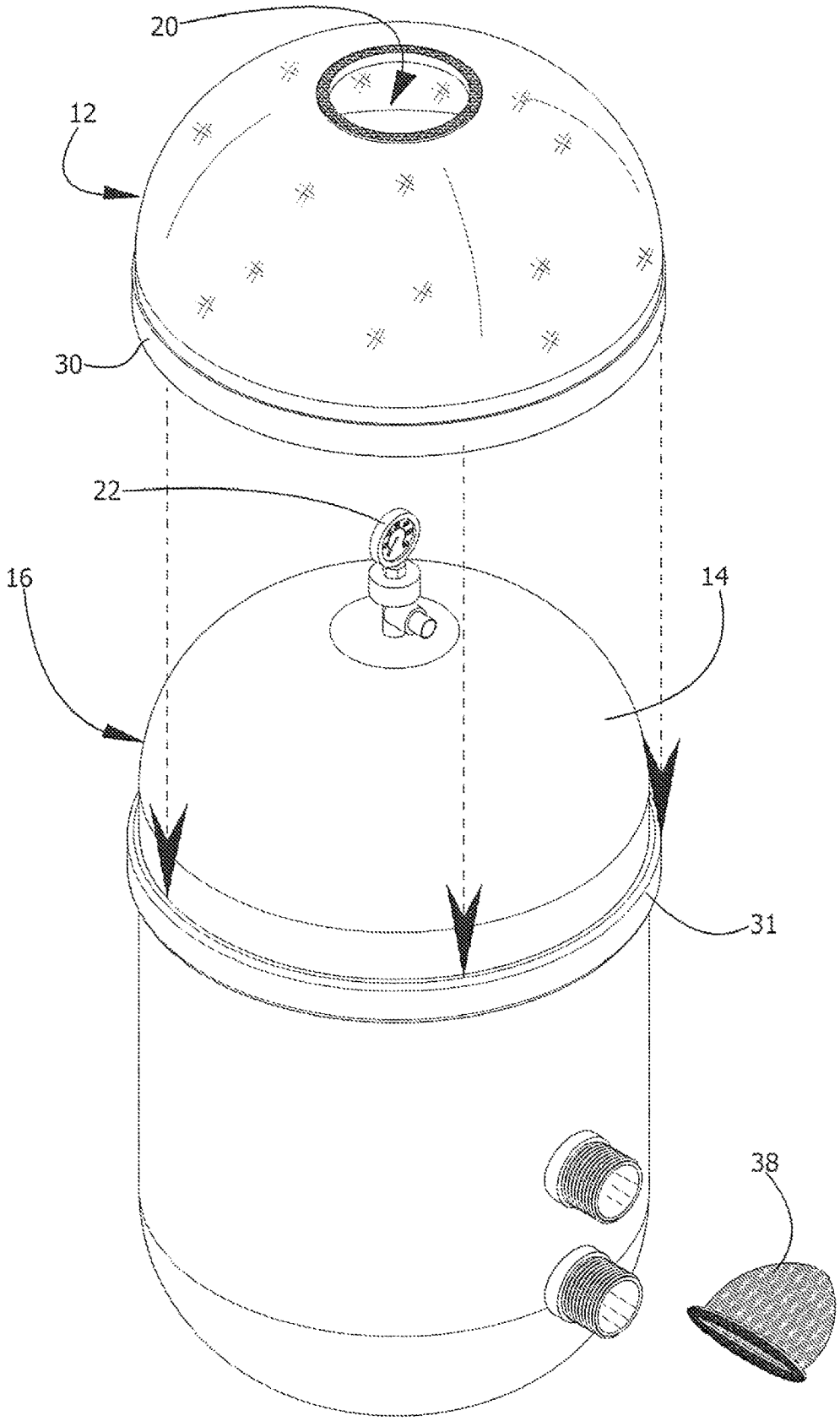
FIG. 3 is an exploded in-use view of an embodiment of the disclosure showing a hood being positioned over a pool filter housing.
Figure 4:
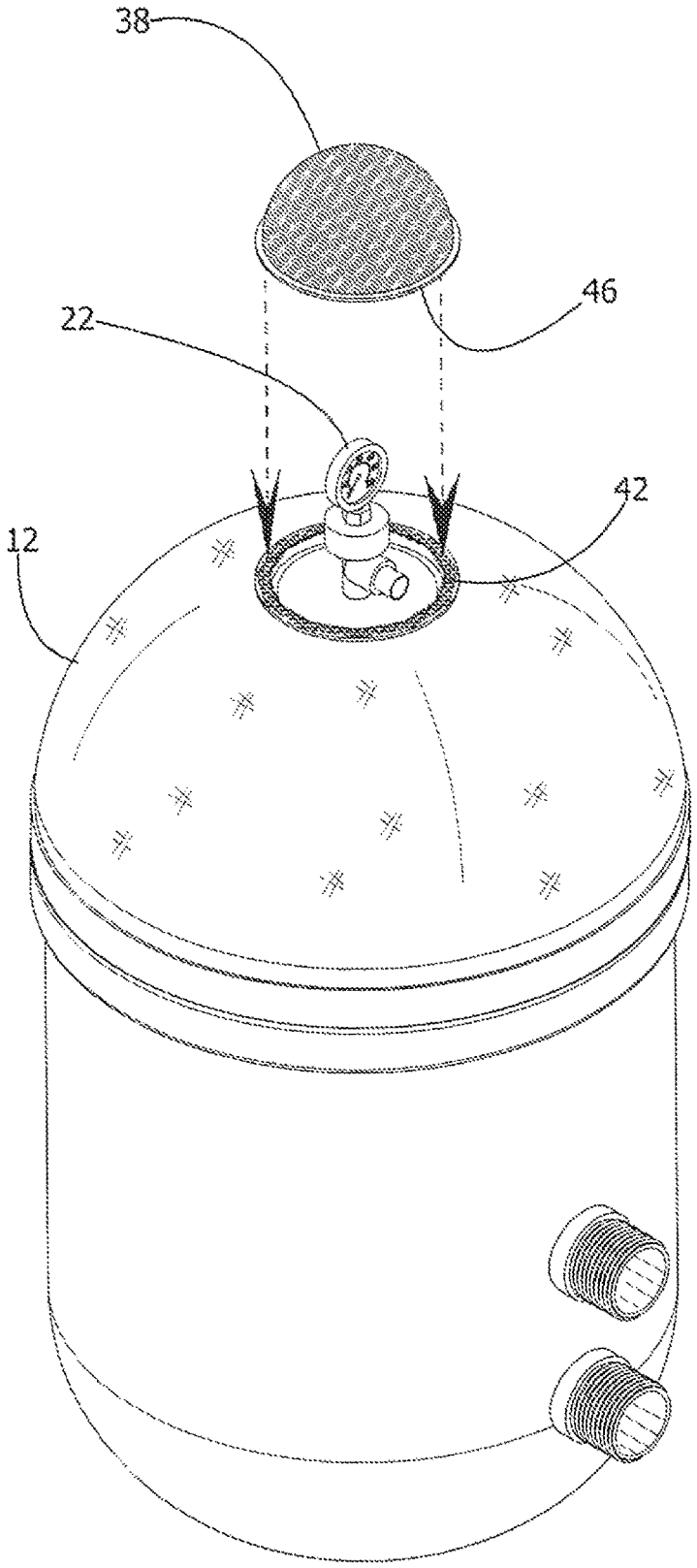
FIG. 4 is an exploded in-use view of an embodiment of the disclosure showing a cover being positioned over a pressure gauge of a pool filter housing.
Figure 5:
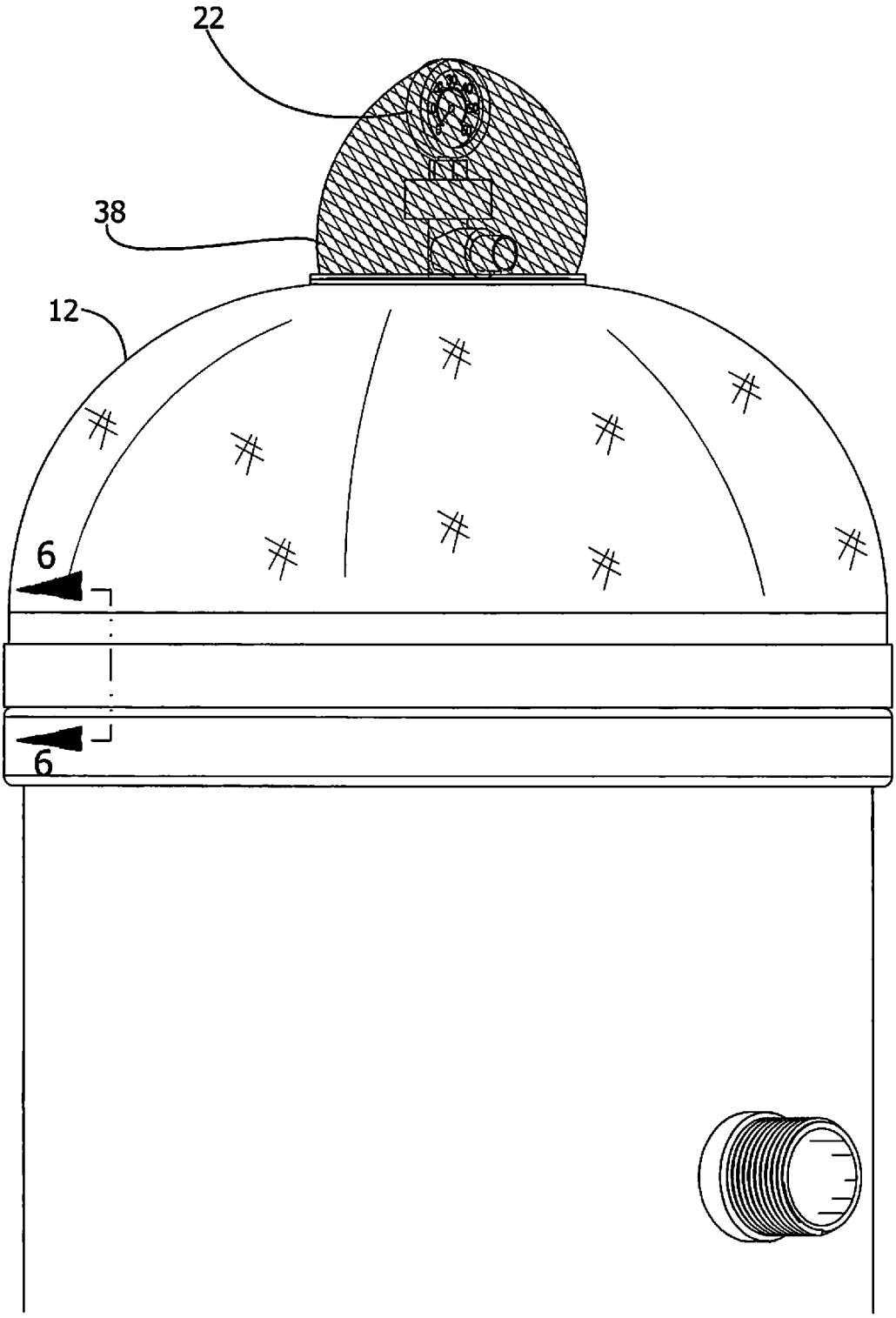
FIG. 5 is a front in-use view of an embodiment of the disclosure.
Figure 6:
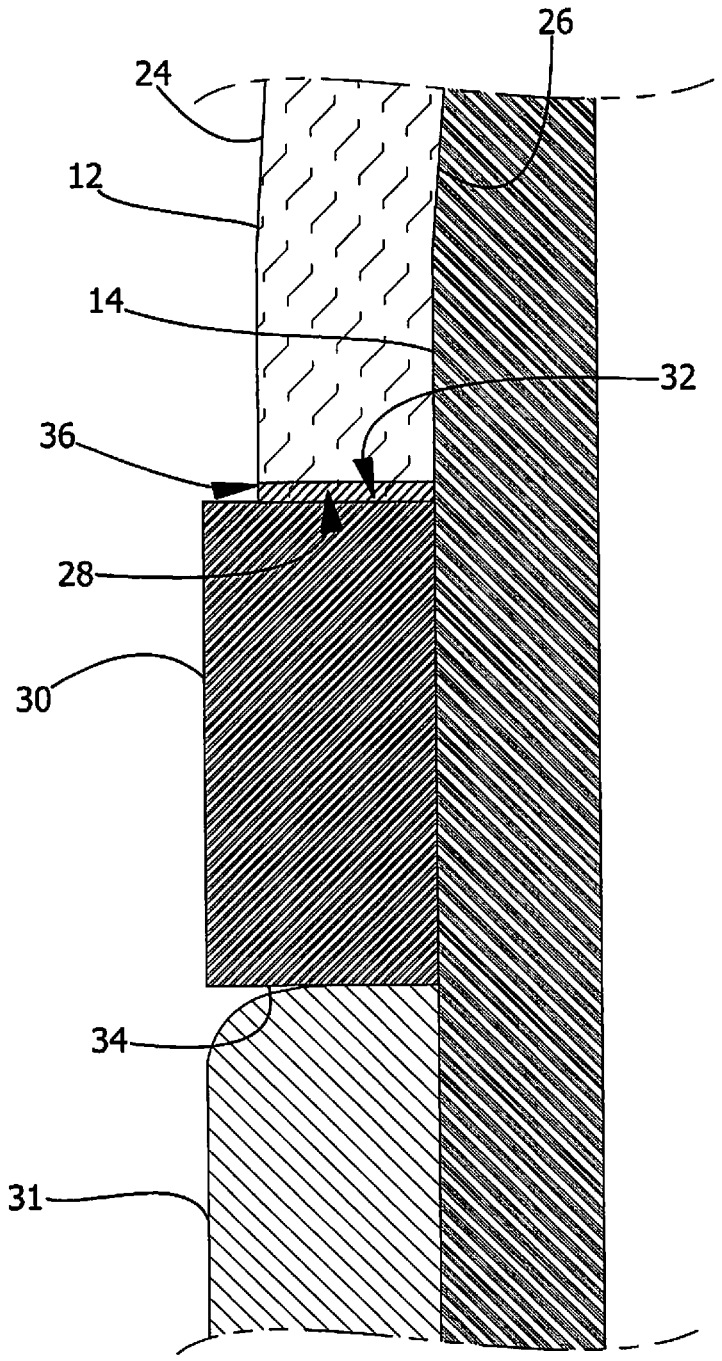
FIG. 6 is a cross sectional view taken along line 6-6 of FIG. 5 of an embodiment of the disclosure.
Figure 7:
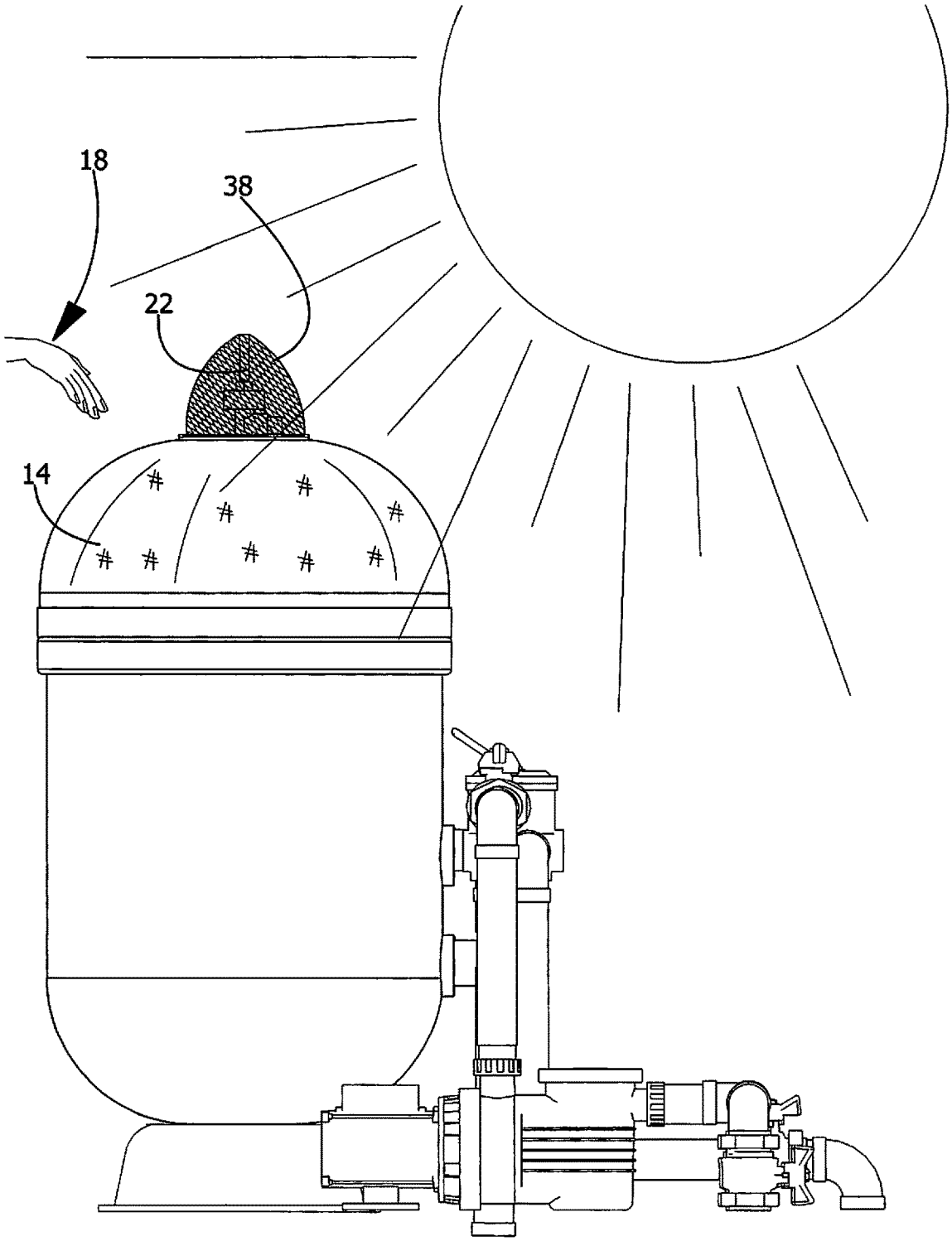
FIG. 7 is a perspective in-use view of an embodiment of the disclosure.

With reference now to the drawings, and in particular to FIGS. 1 through 9 thereof, a new pool filter device embodying the principles and concepts of an embodiment of the disclosure and generally designated by the reference numeral 10 will be described.

As best illustrated in FIGS. 1 through 9, the pool filter protection device 10 generally comprises a hood 12 that is shaped to define a dome which can be placed over a housing 14 for a pool filter 16. The pool filter 16 may be a pool filter of any conventional design that is commonly employed on residential swimming pools and the housing 14 may be comprised of fiberglass or other material that is prone to releasing irritating fibers into the skin of a user 18 that is attempting to service the pool filter 16. The hood 12 has a hole 20 extending through the hood 12 to accommodate a pressure gauge 22 on the housing 14. Furthermore, the hood 12 is comprised of an opaque material, including but not being limited to, canvas or other type of similar material, to protect the housing 14 from ultraviolet light thereby inhibiting the housing 14 from being degraded by sunlight. Additionally, the hood 12 is comprised of a fluid impermeable material, including but not being limited to a rubber coating applied to the canvas or other similar type of material, to inhibit fibers from the housing 14 from irritating skin of the user 18 when the user 18 is servicing the pool filter 16.

The hood 12 has a bottom surface 24, a top surface 26 and a perimeter edge 28 extending between the top surface 26 and the bottom surface 24 and the perimeter edge 28 is continuously arcuate about a center of the hood 12 such that the hood 12 has a circular shape. The hole 20 extends through the top surface 26 and the bottom surface 24 and the hole 20 is centrally positioned on the hood 12 such that the hole 20 is concentric with the perimeter edge 28. The hole 20 may have a diameter ranging between approximately 10.0 cm and 13.0 cm and the hood 12 may have a diameter ranging between approximately 60.0 cm and 90.0 cm.

A magnet 30 is attached to the hood 12 to magnetically engage a metal ring 31 on the housing 14 for securing the hood 12 on the housing 14. The magnet 30 is continuously arcuate such that the magnet 30 defines a ring. The magnet 30 has a first surface 32 that is attached to the perimeter edge 28 of the hood 12 such that the magnet 30 extends around a full circumference of the perimeter edge 28. In this way a second surface 34 of the magnet 30 can magnetically engage the metal ring 31 on the housing 14 when the hood 12 is positioned over the housing 14. As is most clearly shown in FIG. 6, an adhesive 36 may be applied between the perimeter edge 28 of the hood 12 and the first surface 32 of the magnet 30 for affixing the magnet 30 to the hood 12.

A cover 38 is removably attachable to the hood 12 having the cover 38 being aligned with the hole 20. In this way the cover 38 can cover the pressure gauge 22 when the hood 12 is positioned over the housing 14. The cover 38 is comprised of a mesh material to facilitate the pressure gauge 22 to be visible to the user 18 through the cover 38. In this way the user 18 can read the pressure gauge 22 without having to remove the hood 12 from the housing 14. The cover 38 has a perimeter edge 40 that is continuously arcuate about a center of the cover 38 such that the perimeter edge 40 of the cover 38 defines a circle.

A first coupler 42 is attached to the hood 12 and the first coupler 42 is oriented to surround the hole 20 in the hood 12. The first coupler 42 is positioned on the top surface 26 of the hood 12 and the first coupler 42 extends around a bounding edge 44 of the hole 20. A second coupler 46 is attached to the cover 38 and the first coupler 42 is releasably matable to the second coupler 46 for retaining the cover 38 on the hood 12. The second coupler 46 is attached to the perimeter edge 40 of the cover 38 such that the second coupler 46 extends around a full circumference of the perimeter edge 40 of the cover 38. Additionally, each of the first coupler 42 and the second coupler 46 may comprise complementary portions of a hook and loop fastener or the like.

Figure 8:
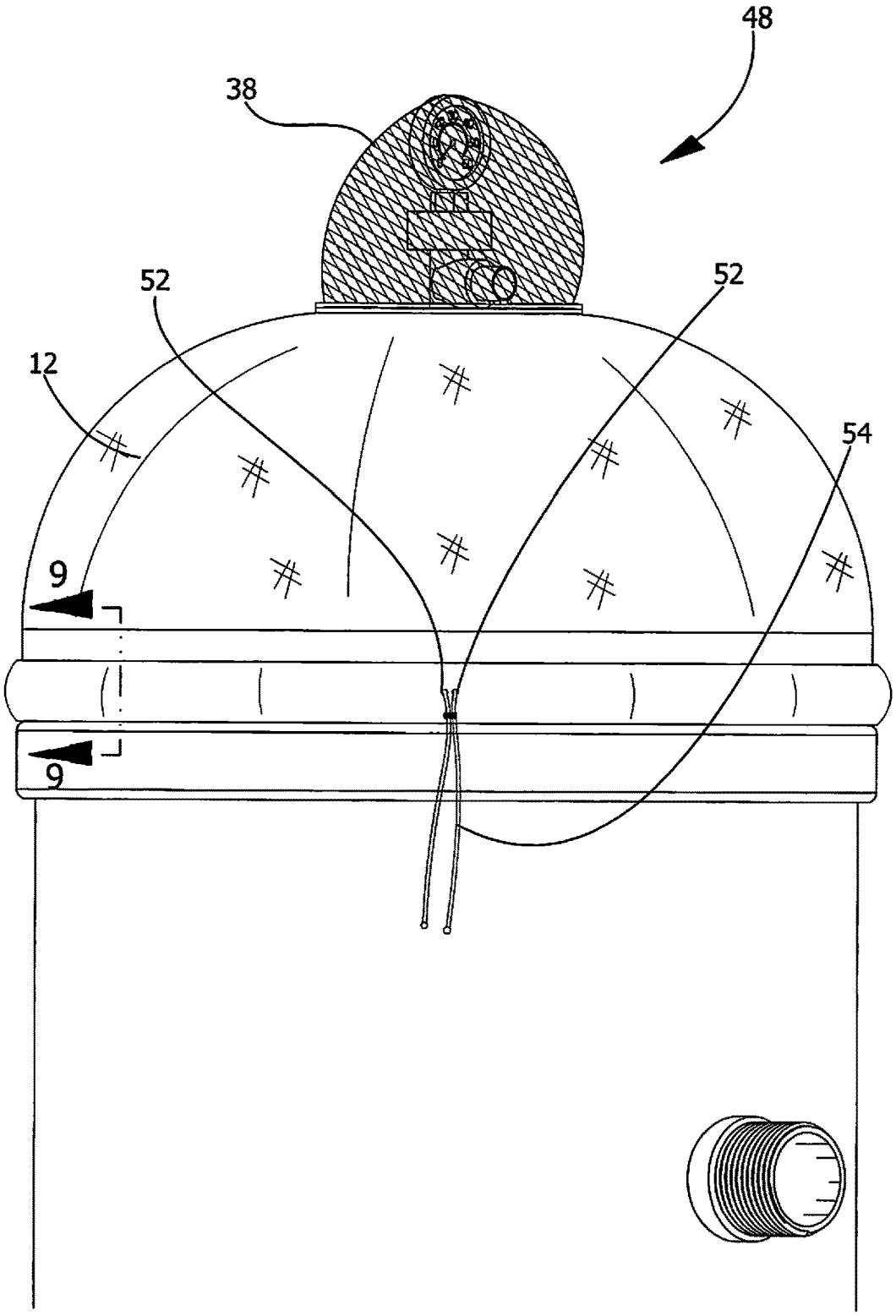
FIG. 8 is a perspective in-use view of an alternative embodiment of the disclosure.
Figure 9:
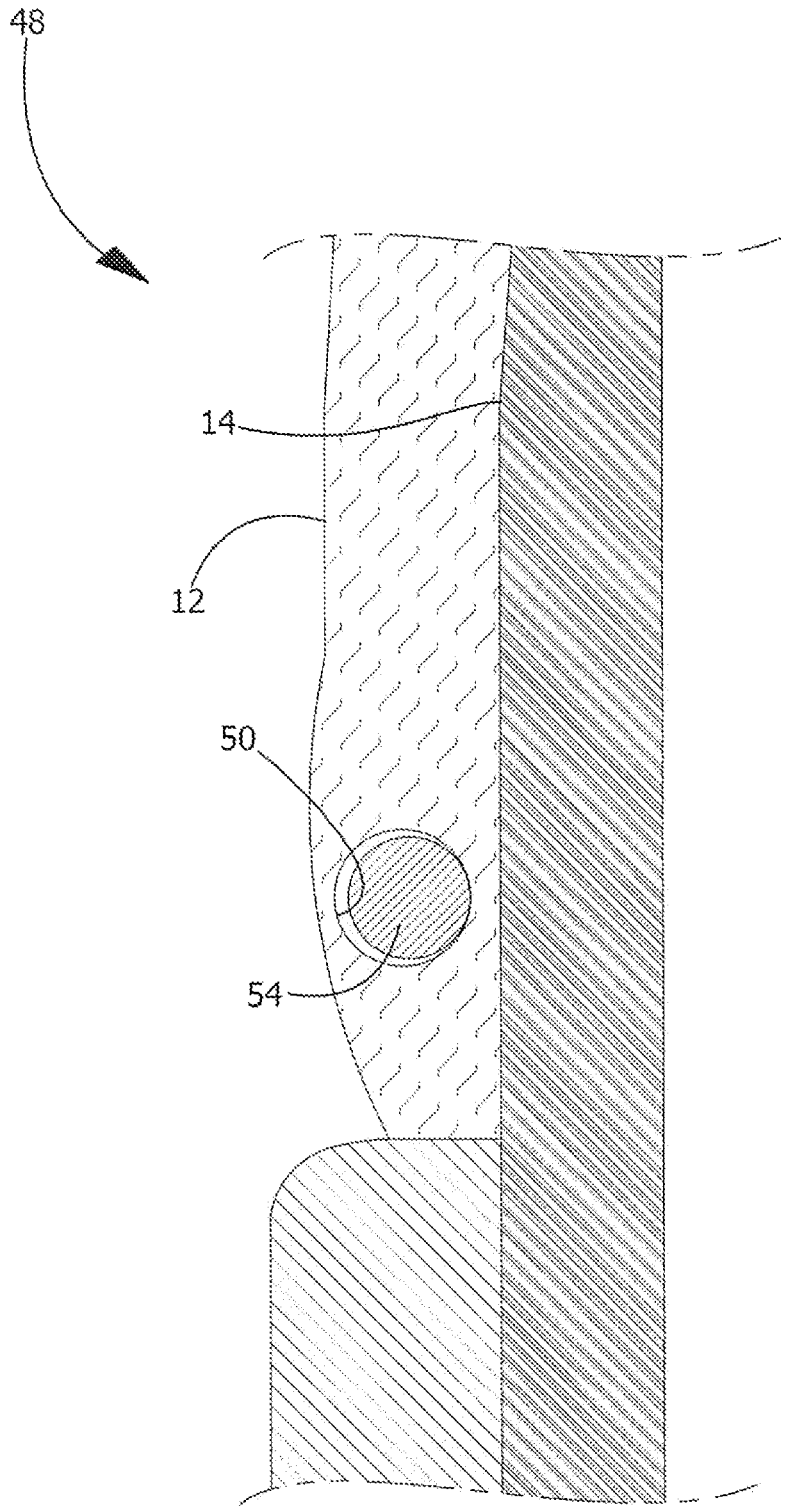
FIG. 9 is a cross sectional view taken along line 9-9 of FIG. 8 of an embodiment of the disclosure.

In an alternative embodiment 48 shown in FIGS. 8 and 9, a channel 50 is integrated into the hood 12 and the channel 50 is spaced from and is coextensive with the perimeter edge 28 of the hood 12. The hood 12 has a pair of openings 52 each extending into the channel 50 and the openings 52 are spaced apart from each other. A drawstring 54 is movably positioned in the channel 50 such that the drawstring 54 extends outwardly from each of the pair of openings 52. In this way the drawstring 54 can be tightened around the housing 14 for securing the hood 12 on the housing 14.

In use, the hood 12 is placed over the housing 14 of the pool filter 16 such that the hole 20 is aligned with the pressure gauge 22 to facilitate the pressure gauge 22 to extend through the hole 20. The magnet 30 is manipulated to magnetically engage the metal ring 31 on the housing 14 to secure the hood 12 to the housing 14. The cover 38 is placed over the pressure gauge 22 and the first coupler 42 is mated to the second coupler 46 for securing the cover 38 to the hood 12. In this way the housing 14 of the pool filter 16 is protected from ultraviolet light from the sun while facilitating the gauge to be visible. Furthermore, the hood 12 protects the user's 18 skin from irritating fibers that can often result from handling objects constructed of fiberglass.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pool filter protection device for protecting a pool filter from ultraviolet radiation from the sun, said device comprising:

a hood being shaped to define a dome wherein said hood is configured to be placed over a housing for a pool filter, said hood having a hole extending through said hood wherein said hole is configured to accommodate a pressure gauge on the housing, said hood being comprised of an opaque material wherein said hood is configured to protect the housing from ultraviolet light thereby inhibiting the housing from being degraded by sunlight, said hood being comprised of a fluid impermeable material wherein said hood is configured to inhibit fibers from the housing from irritating skin of a user when the user is servicing the pool filter;

a magnet being attached to said hood wherein said magnet is configured to magnetically engage a metal ring on the housing for securing said hood on the housing, said magnet being continuously arcuate such that said magnet defines a ring; and a cover being removably attachable to said hood having said cover being aligned with said hole wherein said cover is configured to cover the pressure gauge when said hood is positioned over the housing, said cover being comprised of a mesh material wherein said cover is configured to facilitate the pressure gauge to be visible to the user through said cover.

2. The device according to claim 1, wherein:

said hood has a bottom surface and a top surface and a perimeter edge extending between said top surface and said bottom surface, said perimeter edge being continuously arcuate about a center of said hood such that said hood has a circular shape, said hole extending through said top surface and said bottom surface, said hole being centrally positioned on said hood such that said hole is concentric with said perimeter edge; and said magnet has a first surface being attached to said perimeter edge of said hood such that said magnet extends around a full circumference of said perimeter edge wherein a second surface of said magnet is configured to magnetically engage the metal ring on the housing when said hood is positioned over the housing.

3. The device according to claim 2, further comprising a first coupler being attached to said hood, said first coupler being oriented to surround said hole in said hood, said first coupler being positioned on said top surface of said hood, said first coupler extending around a bounding edge of said hole.

4. The device according to claim 1, wherein:

said device includes a first coupler being attached to said hood;

said cover has a perimeter edge being continuously arcuate about a center of said cover such that said perimeter edge of said cover defines a circle; and said device includes a second coupler being attached to said cover, said first coupler being releasably matable to said second coupler for retaining said cover on said hood, said second coupler being attached to said perimeter edge of said cover such that said second coupler extends around a full circumference of said perimeter edge of said cover.

5. A pool filter protection device for protecting a pool filter from ultraviolet radiation from the sun, said device comprising:

a hood being shaped to define a dome wherein said hood is configured to be placed over a housing for a pool filter, said hood having a hole extending through said hood wherein said hole is configured to accommodate a pressure gauge on the housing, said hood being comprised of an opaque material wherein said hood is configured to protect the housing from ultraviolet light thereby inhibiting the housing from being degraded by sunlight, said hood being comprised of a fluid impermeable material wherein said hood is configured to inhibit fibers from the housing from irritating skin of a user when the user is servicing the pool filter, said hood having a bottom surface and a top surface and a perimeter edge extending between said top surface and said bottom surface, said perimeter edge being continuously arcuate about a center of said hood such that said hood has a circular shape, said hole extending through said top surface and said bottom surface, said hole being centrally positioned on said hood such that said hole is concentric with said perimeter edge;

a magnet being attached to said hood wherein said magnet is configured to magnetically engage a metal ring on the housing for securing said hood on the housing, said magnet being continuously arcuate such that said magnet defines a ring, said magnet having a first surface being attached to said perimeter edge of said hood such that said magnet extends around a full circumference of said perimeter edge wherein a second surface of said magnet is configured to magnetically engage the metal ring on the housing when said hood is positioned over the housing;

a first coupler being attached to said hood, said first coupler being oriented to surround said hole in said hood, said first coupler being positioned on said top surface of said hood, said first coupler extending around a bounding edge of said hole;

a cover being removably attachable to said hood having said cover being aligned with said hole wherein said cover is configured to cover the pressure gauge when said hood is positioned over the housing, said cover being comprised of a mesh material wherein said cover is configured to facilitate the pressure gauge to be visible to the user through said cover, said cover having a perimeter edge being continuously arcuate about a center of said cover such that said perimeter edge of said cover defines a circle; and a second coupler being attached to said cover, said first coupler being releasably matable to said second coupler for retaining said cover on said hood, said second coupler being attached to said perimeter edge of said cover such that said second coupler extends around a full circumference of said perimeter edge of said cover.

6. The device according to claim 5, further comprising:

a channel being integrated into said hood, said channel being spaced from and being coextensive with said perimeter edge of said hood;

said hood having a pair of openings each extending into said channel, said pair of openings being spaced apart from each other; and a drawstring being movably positioned in said channel such that said drawstring extends outwardly from each of said pair of openings wherein said drawstring is configured to be tightened around the housing for securing said hood on the housing.

7. A pool filter protection system for protecting a pool filter from ultraviolet radiation from the sun, said system comprising:

a pool filter having a housing and a pressure gauge attached to said housing;

a hood being shaped to define a dome to facilitate said hood to be placed over said housing for said pool filter, said hood having a hole extending through said hood to accommodate said pressure gauge on said housing, said hood being comprised of an opaque material wherein said hood is configured to protect said housing from ultraviolet light thereby inhibiting said housing from being degraded by sunlight, said hood being comprised of a fluid impermeable material wherein said hood is configured to inhibit fibers from said housing from irritating skin of a user when the user is servicing the pool filter, said hood having a bottom surface and a top surface and a perimeter edge extending between said top surface and said bottom surface, said perimeter edge being continuously arcuate about a center of said hood such that said hood has a circular shape, said hole extending through said top surface and said bottom surface, said hole being centrally positioned on said hood such that said hole is concentric with said perimeter edge;

a magnet being attached to said hood wherein said magnet is configured to magnetically engage a metal ring on said housing for securing said hood on said housing, said magnet being continuously arcuate such that said magnet defines a ring, said magnet having a first surface being attached to said perimeter edge of said hood such that said magnet extends around a full circumference of said perimeter edge such that a second surface of said magnet magnetically engages said metal ring on said housing when said hood is positioned over said housing;

a first coupler being attached to said hood, said first coupler being oriented to surround said hole in said hood, said first coupler being positioned on said top surface of said hood, said first coupler extending around a bounding edge of said hole;

a cover being removably attachable to said hood having said cover being aligned with said hole to cover said pressure gauge when said hood is positioned over said housing, said cover being comprised of a mesh material facilitate said pressure gauge to be visible to the user through said cover, said cover having a perimeter edge being continuously arcuate about a center of said cover such that said perimeter edge of said cover defines a circle; and a second coupler being attached to said cover, said first coupler being releasably matable to said second coupler for retaining said cover on said hood, said second coupler being attached to said perimeter edge of said cover such that said second coupler extends around a full circumference of said perimeter edge of said cover.

* * * * *